United States Patent [19]

Moorhouse

[11] 4,399,672

[45] Aug. 23, 1983

[54] AUXILIARY SECURITY LOCK ASSEMBLY FOR A DOOR

[76] Inventor: John H. Moorhouse, Clear Lake, Minn. 55319

[21] Appl. No.: 286,780

[22] Filed: Jul. 27, 1981

[51] Int. Cl.[3] ..... E05B 73/00; E05C 19/18

[52] U.S. Cl. ..... 70/101; 70/14; 70/461; 292/289; 292/292; 292/296; 292/297

[58] Field of Search ..... 70/14, 19, 39, 2, 3, 70/6, 91, 51-54, 101, 102, 462, 461; 292/DIG. 60, 258, 270, 292-298, 288, 289

[56] References Cited

U.S. PATENT DOCUMENTS

| | | | |
|---|---|---|---|
| 10,511 | 2/1854 | Webb | 292/292 |
| 211,232 | 1/1879 | Forbes | 292/292 X |
| 297,465 | 4/1884 | Starrett | 292/298 |
| 413,128 | 10/1889 | Brabson | 70/14 |
| 463,361 | 11/1891 | Frazier | 70/14 |
| 583,363 | 5/1897 | Dunwald | 70/14 |
| 584,677 | 6/1897 | Doyle | 292/292 |
| 628,735 | 7/1899 | Wold | 292/292 |
| 749,515 | 1/1904 | Bail | 292/296 |
| 928,820 | 7/1909 | Tabor | 70/14 |
| 969,631 | 9/1910 | Johnson | 292/293 |
| 980,498 | 1/1911 | Day | 292/293 |
| 1,168,107 | 1/1916 | Oldham | 70/14 |
| 1,406,397 | 2/1922 | Lincoln | 292/296 X |
| 1,472,698 | 10/1923 | Testa | 292/290 |
| 1,502,933 | 7/1924 | Allen | 292/292 |
| 1,549,182 | 8/1925 | Church | 292/292 |
| 1,717,964 | 6/1929 | Dorion | 292/293 |
| 2,055,906 | 9/1936 | Menchen | 70/14 |
| 2,461,398 | 2/1949 | Sands | 292/290 X |
| 2,924,479 | 2/1960 | Butler | 292/296 |
| 2,924,960 | 2/1960 | Palazzo | 70/39 X |
| 3,181,319 | 5/1965 | Hudon | 292/292 X |
| 3,451,235 | 6/1969 | Weingart | 70/14 |
| 3,475,929 | 11/1969 | Weingart | 70/14 |
| 3,726,555 | 4/1973 | Lawson | 292/291 |
| 3,834,746 | 9/1974 | Hinden | 292/DIG. 60 X |
| 3,854,764 | 12/1974 | Corrigan | 292/289 |
| 3,908,415 | 9/1975 | Foote | 70/53 X |
| 3,973,420 | 8/1976 | Brady et al. | 70/101 X |
| 4,059,299 | 11/1977 | Huntley | 70/14 X |
| 4,326,394 | 4/1982 | Stein | 70/14 |

FOREIGN PATENT DOCUMENTS

| | | | |
|---|---|---|---|
| 874314 | 6/1971 | Canada | 292/296 |
| 401427 | 9/1924 | Fed. Rep. of Germany | 70/14 |
| 2254100 | 5/1973 | Fed. Rep. of Germany | 292/288 |

*Primary Examiner*—Cornelius J. Husar
*Assistant Examiner*—Carl F. Pietruszka
*Attorney, Agent, or Firm*—Leo Gregory

[57] ABSTRACT

An auxiliary lock assembly for a door hung in a frame consisting of a plate member having a portion disposed between the door and the door frame and extending inwardly of the door, a plate holding member having a slot receiving the extended portion of the plate member and engaging the inner side of the door to secure the plate member thereto, an angled portion of the plate member overlying an outer side portion of the door and having a pair of laterally spaced horizontal elongated locking members extending outwardly thereform, one of the locking members being pivoted to permit the door to close into the door frame and a lock member receiving and securing the elongated locking members and the lock member having a shoulder engaging the door frame.

8 Claims, 12 Drawing Figures

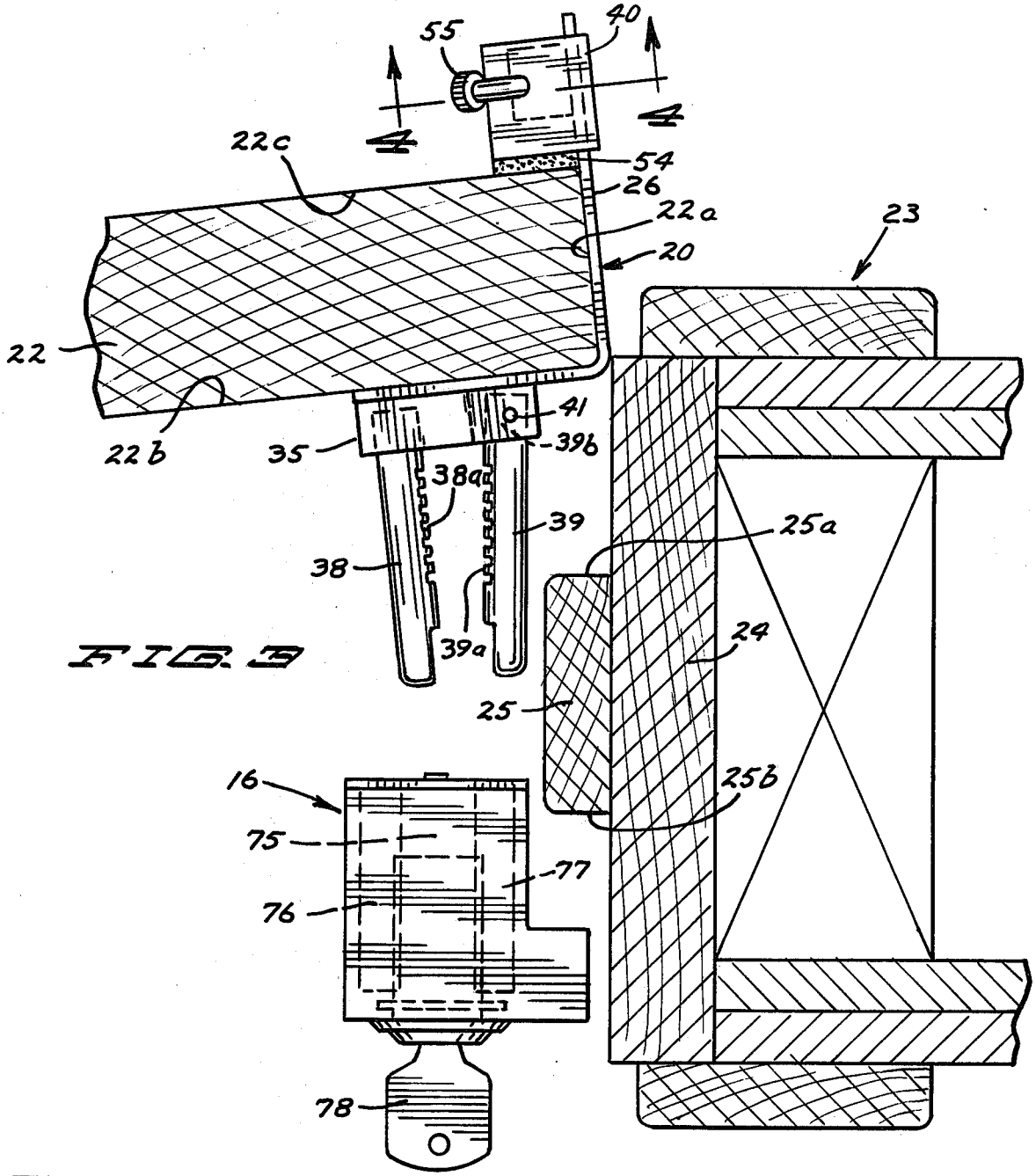
FIG. 3
FIG. 4
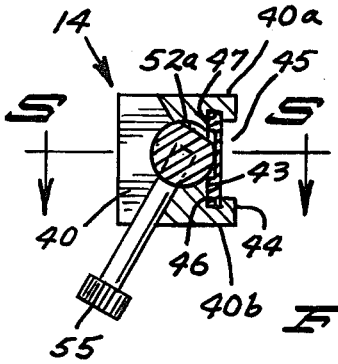
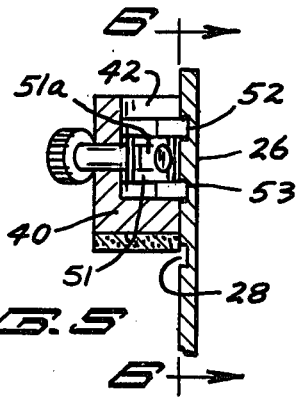
FIG. 5
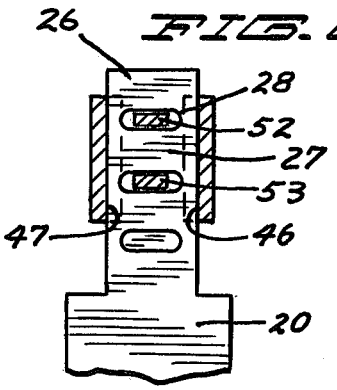
FIG. 6

FIG. 7
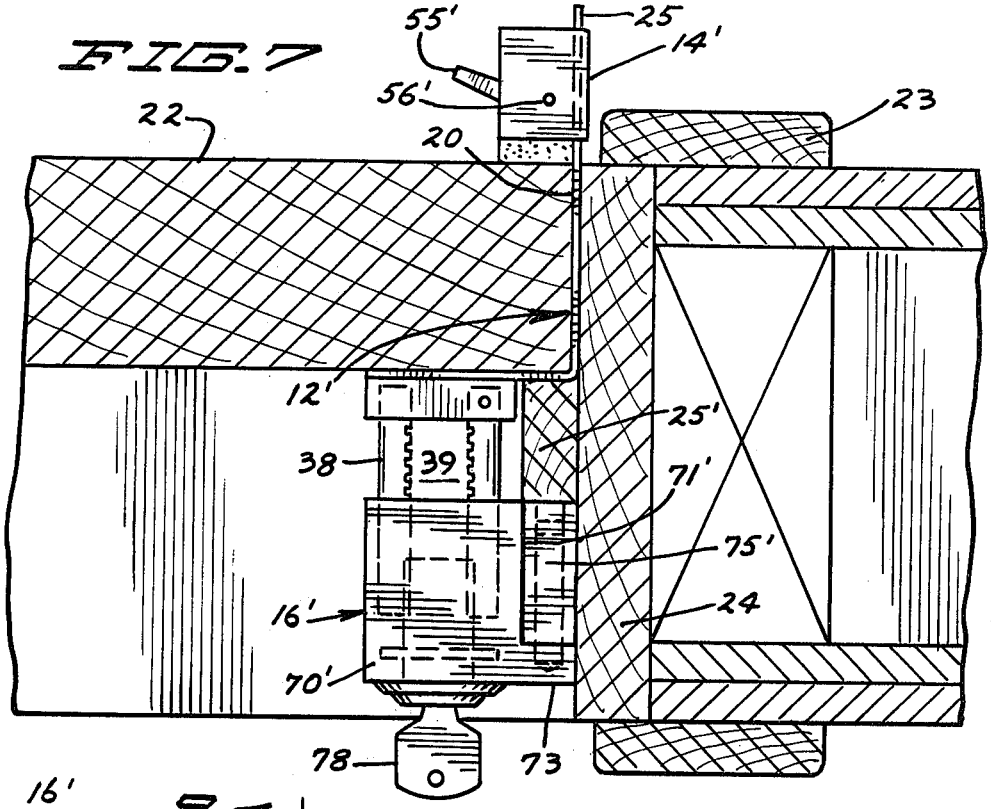
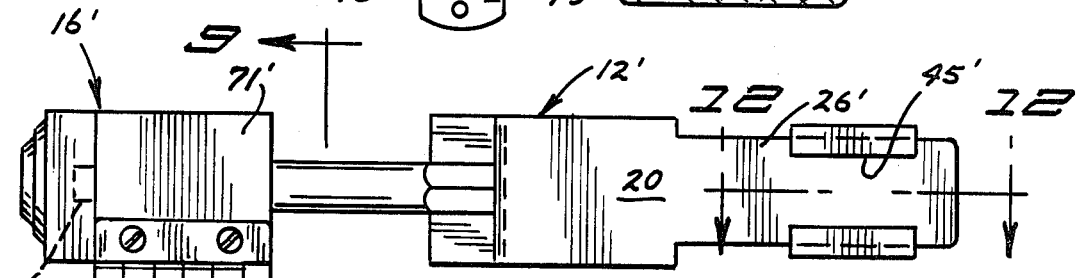
FIG. 8
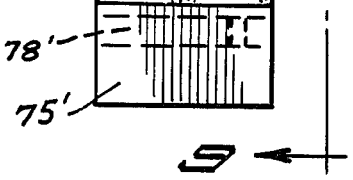
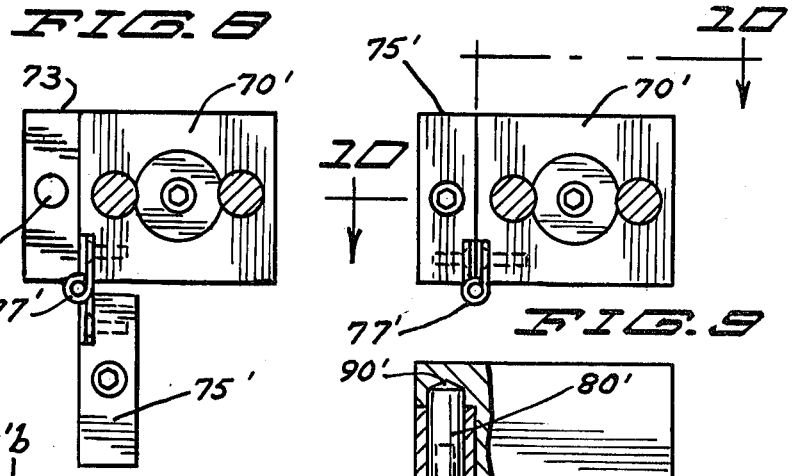
FIG. 9
FIG. 11
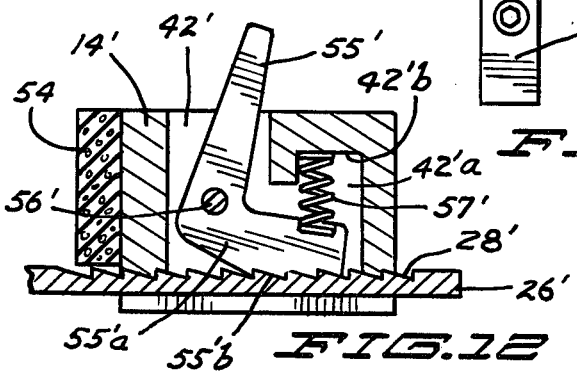
FIG. 12
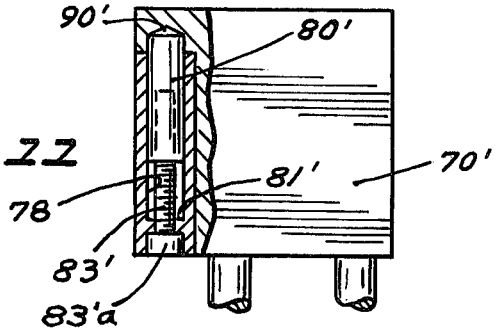
FIG. 10

AUXILIARY SECURITY LOCK ASSEMBLY FOR A DOOR

BACKGROUND OF THE INVENTION

1. Field of the Invention

This invention relates to an auxiliary lock assembly for a door hung in a door frame.

2. Description of the Prior Art

This application is a substitute for abandoned prior application Ser. No. 126,586 filed Mar. 3, 1980, earlier abandoned.

Representative of known devices used as auxiliary locking means is the disclosure in U.S. Pat. No. 3,181,319 to M. A. Hudon wherein a plate member is clamped to a door and a padlock is attached to an extended plate portion and the housing of the lock is intended to bear against the door jamb a positive holding engagement is not provided here.

In U.S. Pat. No. 3,834,746 to Allen W. Hinden, there is disclosed a drawer securing device in which an angled plate member is secured to a vertical front wall of the drawer opening and extends outwardly to have a latching means thereon bearing against the outer wall of the drawer. Here the lock is carried by a stationary wall and is not adapted for use in connection with a door hung in a frame.

The structure disclosed herein represents substantial improvement as will be described herein.

SUMMARY OF THE INVENTION

It is prudent to supplement the locks on hotel and motel room doors with auxiliary security means. It is well to have a room secure against unauthorized or undesired entry as by the use of duplicate or master pass keys and to deter entry by other means.

It is the purpose and object of this invention to provide an auxiliary security lock assemby for a frame hung door to prevent unauthorized or undesired entry into a room as by the use of a pass key and to deter other unauthorized entry for a sufficient length of time to discourage such other entry.

It is another object of this invention to provide an auxiliary security lock assembly for a door, which lock assembly is convenient to carry and which is easily and readily assembled for use and which may be secured to various thicknesses of doors.

More particularly, it is the object of this invention to provide for a frame hung door an auxiliary lock assembly consisting of a horizontal vertically disposed plate member having an end portion extending between the door and its frame and extending inwardly of the door, a plate holding member slidable into said extended plate portion to engage the door, an angled portion of said plate member overlying an outer side portion of the door and having lock engaging members extending therefrom, said lock engaging members being arranged to yield to permit the door to close into its frame, a lock member receiving and securing said lock engaging members and said lock member having a shoulder portion for positive engagement with said door frame against inward opening of said door.

These and other objects and advantages of the invention will be set forth in the following description made in connection with the accompanying drawings in which like reference characters refer to similar parts throughout the several views.

DESCRIPTION OF THE DRAWINGS

FIG. 3 is a view similar to that of FIG. 2 showing the device in unlatched position;

FIG. 4 is a view in horizontal section taken on line 4—4 of FIG. 3 as indicated;

FIG. 5 is a view in horizontal section taken on line 5—5 of FIG. 4 as indicated;

FIG. 6 is a view in vertical section taken on line 6—6 of FIG. 5 as indicated;

FIG. 7 is a view similar to that of FIG. 2 showing a modification thereof;

FIG. 8 is a view in rear elevation;

FIG. 9 is a view in vertical section taken on line 9—9 of FIG. 8 as indicated;

FIG. 10 is a view partially in vertical section taken on line 10—10 as indicated;

FIG. 11 is a view similar to that of FIG. 10 showing an alternate position of a portion thereof; and FIG. 12 is a view in horizontal section taken on line 12—12 as indicated.

DESCRIPTION OF A PREFERRED EMBODIMENT

Figure 2:
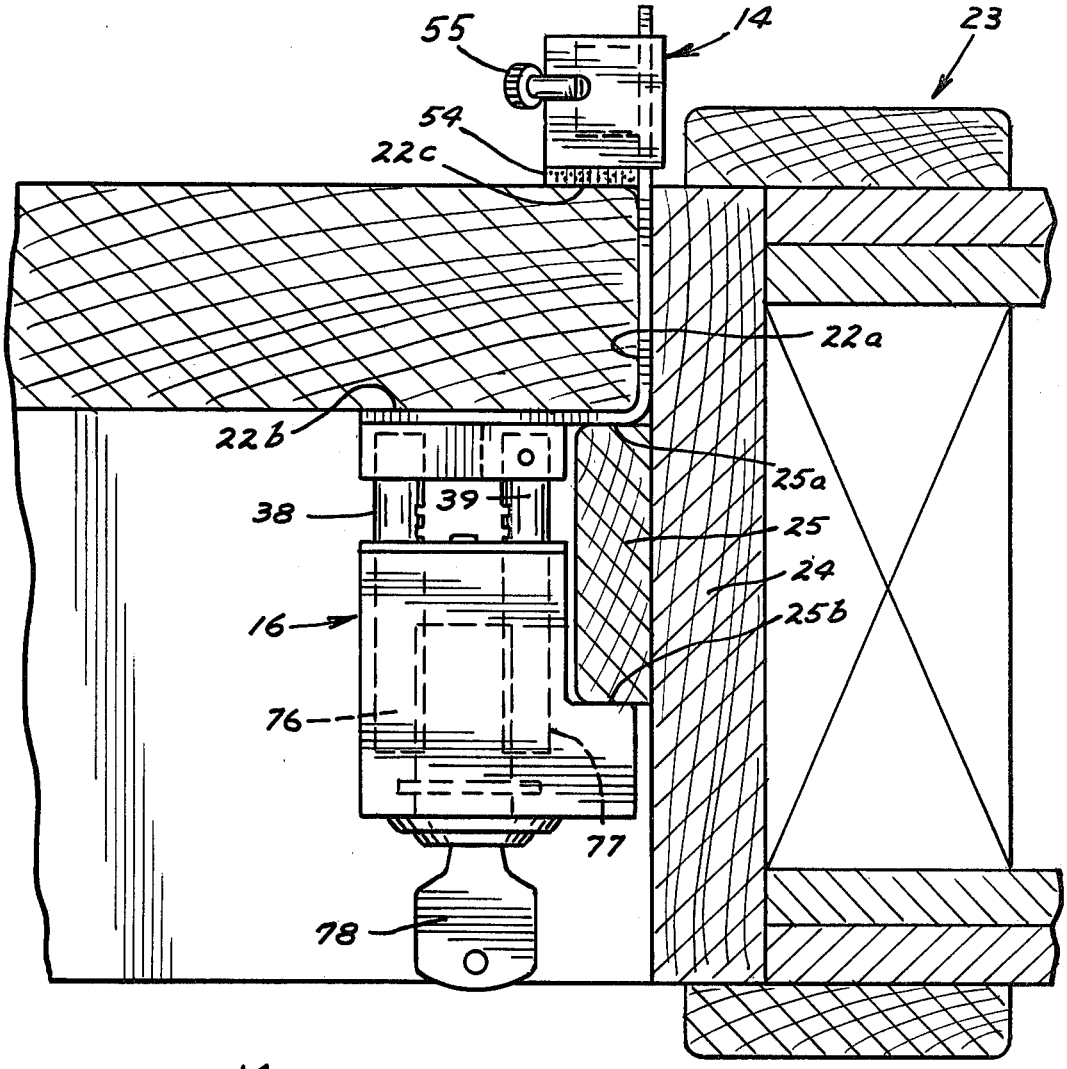
FIG. 2 is a top plan view showing the device herein in latched position with portions thereof in dotted line.
Figure 1:
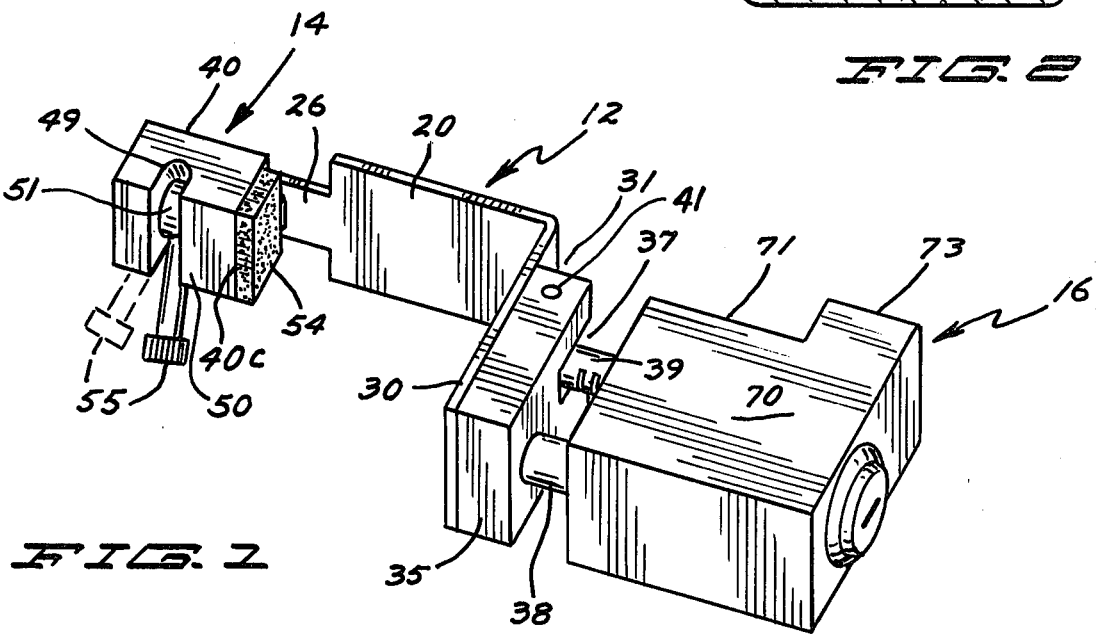
FIG. 1 is a view in perspective.

Referring to the drawings, the auxiliary security latching means or lock assembly herein is indicated generally by the reference numeral 10.

Comprising said lock assembly are three basic components, namely, a door mounting plate member 12, a plate holding member 14 and a lock member 16.

The door mounting member 12 comprises a straight body portion 20 formed as an elongated plate member having such a thickness as to be disposed between the end wall or edge portion 22*a* of a door 22 and its adjacent jamb strip 24 of the door frame 23. Said body portion in the present embodiment has a rearward extending plate portion 26 of reduced width having formed in a surface portion 27 thereof a plurality of spaced recesses 28. The other or outer end portion 30 of said member 12 is angled to overlie the outer facing portion 22*b* of said door 22 and said angled portion as here shown has an increased thickness formed by securing thereto a block member 35, the same being suitably secured as by screws or welding, not here shown, and being set back from the plane of the plate portion 20 as indicated at 31 to the extent of the thickness of the door frame stop member 25 carried by said jamb strip 24.

Extending forwardly of said member 35 are a pair of horizontally spaced notched elongated lock engaging cylindrical members 38 and 39 of small transverse dimension adapted to be received and secured within the lock member 16. The lock engaging member 38 is rigid with said member 35 and said member 39 has an end portion 39*b* disposed into an endwise open slot 37 of said member 35 in which it is secured by a pin 41 providing it with a horizontal swinging or pivotal movement.

Securing said member 12 to door 22 is said plate holding member 14 comprising as here shown a block member 40 substantially square in cross section having an open ended chamber or bore 42 therein partially therethrough and having a longitudinal open faced slot 43 across the side 44 thereof which intersects said bore or chamber forming an open side 45 therein and said slot forms a pair of facing grooves 46 and 47 into the adjacent side walls 40*a* and 40*b* of said member 40. A vertical open ended slot 49 is formed through the side 50 of said block member 40 which is opposite of said first mentioned side 44.

Disposed into said bore or chamber 42 is a rotatable member 51 shown here to be cylindrical in form. Said cylindrical member 51 has a central hub portion 51*a* contained within said bore and having projecting outwardly at each end thereof annular ringlike or rib portions 52 and 53 which extend into said open slot 43 as indicated in FIG. 5 and each have a flat face portion as at 52*a* which at one position of said cylindrical member 51 are flush with the plane of said open slot 43.

Operating said cylindrical member 51 is a handle 55 secured thereto as by being threaded thereinto and the same extends outwardly of the slot 49.

Said slot 43 receives thereto said plate member 26 retained by said grooves 46 and 47 and said member 51 when rotated by said pin 55 causes the projecting rib portions 52 and 53 to enter into a corresponding pair of said recesses 28 to secure said plate holding member 14 and said plate portion 26 against relative movement. A pad 54 is secured to the end wall 40*c* of said member 14 which will be positioned on said plate portion 26 to engage the surface portion 22*c* of said door 22.

Adapted to engage said locking members 38 and 39 is the lock member 16 which comprises a block shaped housing 70 having a portion 71 of reduced width corresponding with the width of said member 35 and having a portion 73 thereof forming a shoulder and projecting outwardly to the plane of said member 20 and being adapted to overlie and engage the outer edge portion 25*b* of the stop strip 25. Said members 38 and 39 will be received and secured in the passages 76 and 77 of said lock member.

Disposed within said block 70 is a cylindrical tumbler 75 to engage said members 38 and 39 which in locked position by operation of the key 78 secures the door 22 against entry. The lock 16 represents conventional structure which is deemed to require no further description or showing.

OPERATION

The auxiliary security lock assembly 10 described above is conveniently carried, particularly when separated into its component parts.

The purpose of the lock assembly herein is to secure a door against entry from the outside in the absence of the room occupant. This is in contrast to prior art devices which secure a door at its inner side against entry from without while the occupant is in the room such as during sleeping hours and such devices do not appear to be adaptable to secure a door at its outer side.

Further, the device herein may be used to secure the door of an inner room as in rented quarters, such as securing a closet door, wherein such a closet may be used to store valuables and entry into such a closet by others is not desired.

The plate member 20 with the plate holding member 14 are readily adapted for use with doors of various thicknesses. Said plate member 20 is applied to an open door as indicated in FIG. 3 and the holding member 14 has the end portion 26 disposed through the slot 43 to the point that the pad 54 engages the door surface at which point the member 55 is swung downwardly to have the projections 52 and 53 seat into the pair of the recesses 28 in register therewith. Thus the plate member 20 is secured to the door.

Upon leaving the room, the occupant closes the door. It is particularly noted here that but for the pivotal movement of the lock engaging member 39, this member would hit against the stop member 25 as the door swings to be closed and but for its pivotal movement, it would prevent the closing of the door or at the least, the stop member 25 would be damaged by engagement therewith in the door being forced to a closed position. The pivotal movement of said lock engaging member 39 is a particular element of novelty.

With the door in closed position, the lock member 16 is applied receiving the two members 38 and 39 into the passages 76 and 77 to be secured therein by the tumbler 75 upon operation of the key 78.

At the inner side of the door, the set back 31 permits tight engagement with the adjacent shoulder 25*a* of the stop member and at the outer side of the door, the shoulder 73 of the lock member 70 engages the outer shoulder 25*b* of the stop member 25. The door is secure in position against shaking and rattling. The security of the lock member 16 effectively prevents entry into the room by use of pass keys, master pass keys or duplicate pass keys and also serves at least as an effective deterrent against entry by other means.

The entire security lock assembly 10 is of relatively inexpensive construction, readily carried about and is very simply assembled for installation. The device has proved to operate very successfully.

MODIFICATION

Shown in FIGS. 7–12 is a modification of the structure above described in which like structure is indicated by like reference numerals with no further description, modified structure is shown by like reference numerals with a prime added and the addition of new structure is indicated by reference numerals with a prime added.

The plate member 20 has its extended portion 26' modified to have ratchet teeth 28' formed therein, the same being on the order of saw teeth in vertical section as here illustrated.

Said block 14' is formed having therein the longitudinal slot 45' substantially as hereinabove described as slot 45. Formed within said block is an angled chamber 42' having an inner sub-chamber 42'*a*. Pivoted within said chamber by a cross pin 56' is an arm latching member 55' extending outwardly of said chamber 42' and having a right angled pawl 55'*a* having a ratchet toothed bottom 55'*b* to normally engage the ratchet teeth 28' under the pressure of the spring member 57' which is shown here as a coil sping disposed within the sub-chamber 42' engaging the adjacent top surface 42'*b* of said sub-chamber at one end thereof and resting upon said pawl 55'*a* at the other end thereof. Said ratchet teeth are herein formed to represent very small increments whereby said block 14' may be secured tightly against the adjacent inside door surface as shown in FIG. 7. The block 14' is readily released by moving the arm of the latching member 55' against the pressure of the spring 57'.

Further change is shown in the lock member 16' in which the block 70' has a portion 75' which is hinged as at 77' to the wall 71' to occupy the portion 71 of reduced width of said block 70 as hereinabove described, said block portion 75' hereinafter being described as a hinged block portion. Said hinged block portion 75' as shown in FIG. 10 has a bore 78' therethrough having a shoulder 81' formed spaced inwardly of the outer end thereof as indicated. Said bore 78' is extended as 90' into the adjacent facing portion of the block 70' as indicated.

Disposed into said bore 78' to abut said shoulder 81' is a tapped sleeve 80' receiving therein a bolt 83' having its head 83'a abutting said shoulder 81' oppositely the side thereof from the adjacent end of the sleeeve 80'. Thus said sleeve and said bolt threaded therein are slideable axially within said bore to the extent that said bolt is threaded into said sleeve and are retained by said shoulder 81'.

Thus the block 70' with the hinged block portion 75' extends substantially the various sized widths of door frame stop members which may be accommodated without unduly elongating the lock engaging members 38 and 39 and thus resulting in a more compact structure.

With the hinged block portion 75' in position as indicated in FIG. 7, a narrow stop strip 25' is accommodated. With said sub-block member 75' swung out of operating position as indicated in FIGS. 8 and 11, a wide stop strip is accommodated such as indicated in FIG. 2.

It will be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. An auxiliary security lock assembly for a door hung in a frame to secure the outer entry side of the door, having in combination a horizontal vertically disposed rigid plate member, one end portion of said plate member being extended longitudinally, a door engaging holding member for said plate member, said holding member having a slot therein to receive said extended end portion of said plate member, said holding member having a chamber therein and having one side of said chamber open to said slot, a rotatably movable member disposed within said chamber, a projecting portion from said movable member extending through said open side into said slot to engage and secure therein said extended end portion of said plate member, said projecting portion having a flat side to be flush with said open side of said chamber in one position of said movable member, a laterally angled portion of said plate member at the other end portion thereof, spaced lock engaging means extending outwardly from said angled portion, pivot means securing at least one of said lock engaging means, locking means receiving and securing therein said lock engaging means, and a laterally projecting door frame engaging shoulder extending from said locking means.

2. The structure set forth in claim 1, wherein a handle from said movable member extends outwardly of said holding member, and said holding member has a slot for movement of said handle.

3. The structure set forth in claim 1, wherein said rotatable member comprises a cylinder, said projecting means comprises a pair of annular ribs, said extended end portion of said plate member has a plurality of recesses formed therein, and said ribs seat into said recesses in register therewith, said holding member being positioned upon said extended end portion to engage said door.

4. A portable auxiliary security lock assembly in combination with a door hung in a door frame to secure the outer entry side of said door, consisting of a rigid plate member disposed between said door and said door frame and having one end portion extending longitudinally inwardly of said door, a laterally angled other end portion of said plate member overlying the outward side of said door, a door engaging holding member, said holding member including means slidably engaging in small increments and releasably securing said first mentioned end portion of said plate member, a pair of lock engaging means extending outwardly of said angled other end portion of said plate member, pivot means securing at least one of said lock engaging means to said angled other end portion of said plate member to permit said door to close into said door frame, locking means receiving therein said lock engaging means, and a laterally projecting shoulder portion of said locking means engaging said door frame.

5. The structure of claim 4, wherein said shoulder portion includes a hinged portion of said locking means, and screw means releasably holding said hinged portion in operating position.

6. A portable auxiliary security lock assembly in combination with a door hung in a door frame to secure the outer entry side of said door, consisting of a member disposed between said door and said door frame, means at the inward side of said door securing said member to said door, spaced elongated projecting lock engaging means carried by said member at the outward side of said door, pivotal means securing at least one of said lock engaging means to said member to permit said door to close into said door frame, locking means receiving therein said lock engaging means, and an integral projection of said locking means engaging said door frame securing said door against the inward opening thereof.

7. The structure of claim 6, wherein a hinged portion carried by said locking means adjusts the width of said projection to accommodate different widths of the stop strip of said door frame.

8. A portable auxiliary security lock assembly in combination with a door hung in a door frame to secure the outer entry side of said door, consisting of a plate member disposed between said door and said door frame and having one end portion extending longitudinally inwardly of said door, a laterally angled other end portion of said plate member overlying the outer side of said door, a door engaging holding member having a slot therein receiving said inwardly extending portion of said plate member, said holding member having a bore therein having one side thereof open to said slot, a rotatable member disposed in said bore, means projecting from said rotatable member extending through said open side of said bore into said slot to engage and secure said plate member portion extending therein, said projecting means in one position of said rotatable member being flush with said open side of said bore, means extending outwardly of said holding member operating said rotatable member, lock engaging means extending outwardly of said angled other end portion of said plate member, yielding means securing said lock engaging means to said angled other end portion to permit said door to close into said door frame, locking means receiving said lock engaging means, a laterally projecting portion of said locking means engaging said door frame, said lock engaging means comprises a pair of laterally spaced members of small cross section dimension, and means pivotally secure one of said lock engaging means to permit said door to close into said frame.

* * * * *